US006050665A

United States Patent [19]

Kishi

[11] Patent Number: 6,050,665

[45] Date of Patent: Apr. 18, 2000

[54] PRINTING DEVICE WITH FUNCTION FOR ADVISING CONTROL UNIT OF RANK OF MOUNTED PRINT HEAD

[75] Inventor: Motoshi Kishi, Nagoya, Japan

[73] Assignee: Brother Kogyo Kabushiki Kaisha, Nagoya, Japan

[21] Appl. No.: 08/933,841

[22] Filed: Sep. 19, 1997

[30] Foreign Application Priority Data

Sep. 19, 1996 [JP] Japan ..... 8-271591

[51] Int. Cl.[7] ..... B41J 29/38

[52] U.S. Cl. ..... 347/14

[58] Field of Search ..... 347/14, 19, 57, 347/58; 395/114; 400/124.05, 175

[56] References Cited

U.S. PATENT DOCUMENTS

| | | | |
|---|---|---|---|
| 3,914,772 | 10/1975 | Kashio | 347/14 |
| 5,039,237 | 8/1991 | Tanuma et al. | 400/125.05 |
| 5,448,269 | 9/1995 | Beauchamp et al. | 347/19 |

FOREIGN PATENT DOCUMENTS

| | | | |
|---|---|---|---|
| 0190873 | 10/1984 | Japan | 400/175 |

*Primary Examiner*—John Barlow
*Assistant Examiner*—Charles W. Stewart, Jr.
*Attorney, Agent, or Firm*—Pollock, Vande Sande & Amernick

[57] ABSTRACT

A printer includes a system for automatically adjusting the drive voltage of a print head according to a predetermined rank characteristic of the head. This is accomplished by initially producing a reference signal along a signal line. The reference signal is delayed by a delay circuit by an amount corresponding to the rank characteristic of the print head. The delayed reference is then compared to the reference signal thereby resulting in the detection of the delay time therebetween. A control signal is subsequently generated that corresponds to the delay time. The control signal is connected to a print head driver through the signal line so that a drive voltage may be generated during a subsequent time interval, the drive voltage corresponding to the rank characteristic of the print head.

18 Claims, 14 Drawing Sheets

WAVEFORMS WHEN BOTH SWITCHING POINTS 35a, 35b, ARE LEFT OPEN

WAVEFORMS WHEN SWITCHING POINT 35a, ONLY IS CONNECTED

WAVEFORMS WHEN SWITCHING POINT 35b, ONLY IS CONNECTED

FIG. 10 (A)

| RANK | VOLTAGE(V) REQUIRED AT 25℃ TO EJECT A DROPLET AT SPEED OF 5m/s |
|---|---|
| NG | V5m/s<16 |
| RANK A | 16≦V5m/s<18 |
| RANK B | 18≦V5m/s<20 |
| RANK C | 20≦V5m/s<23 |
| NG | 23≦V5m/s |

FIG. 10 (B)

| TEMPERATURE RANGE (℃) | DRIVE VOLTAGE (V) | | |
|---|---|---|---|
| | RANK A | RANK B | RANK C |
| 0~ 8 | 25 | 29 | 29 |
| 8~16 | 22 | 25 | 29 |
| 16~25 | 20 | 22 | 25 |
| 25~33 | 18 | 20 | 22 |
| 33~40 | 16 | 18 | 20 |
| 40~45 | 15 | 16 | 18 |
| 45~50 | 14 | 15 | 16 |

PRINTING DEVICE WITH FUNCTION FOR ADVISING CONTROL UNIT OF RANK OF MOUNTED PRINT HEAD

BACKGROUND OF THE INVENTION

1. Field of the Invention

The present invention relates to a printing device capable of automatically distinguishing rank characteristic of a print head mounted in the printing device.

2. Description of the Related Art

There has been known a conventional ink jet printing device that includes piezoelectric elements. The piezoelectric elements deform upon application of voltage. This mechanical deformation of the piezoelectric elements can be used to eject ink droplets for printing. However, a great deal of variation can be seen in manufactured piezoelectric elements. Therefore, even when driven using the same voltage, different heads will eject ink droplets with volumes and at speeds that vary between different print heads. Because different print heads require different voltages, it is necessary to investigate characteristics of the heads before mounting the print heads on printing devices. Print heads are divided into a plurality of ranks according to voltage required to drive them.

One printing device is provided with a control unit for automatically distinguishing the rank of the print head mounted therein and then setting the voltage to be applied to the print head according to the determined rank of the print head. Before the print head is mounted in the print device, circuits provided to the print head unit are cut in a pattern according to the rank characteristic. When the print head is mounted in the print device, the control unit distinguishes the rank of the print head by using a digital signal that varies depending on how the circuits are cut.

Circuitry used by the control unit of this conventional printing device will be described while referring to FIGS. 14 and 15. FIG. 14 is a circuit diagram of the circuit for distinguishing head rank. FIG. 15 is a block diagram of the control system in the printing device provided with the circuit shown in FIG. 14.

As shown in FIG. 14, in the conventional circuit for designating print head rank, a signal line 116 connecting a ground (0 V) and a central process unit (CPU) 150 is divided into two signal lines 122, 124. A cut unit 110 is disposed on a chip mounting board (not shown in FIG. 14) and includes a cut portion 112 for cutting the signal line 122 and a cut portion 114 for cutting the signal line 124. A resistor unit 120 is disposed on the chip mounting board (not shown in FIG. 14) and includes a resister R4 connected to the signal line 122 and a resister R5 connected to the signal line 124. The signal lines 122 and 124 are connected to output their signals to separate predetermined ports of the CPU 150.

When assembling the driver IC chip 160 into the ink jet recording device, the cut portions 112 and 114 are cut in a manner depending on the rank of the print head, that is, depending on the required drive voltage to be set. Three possible cut patterns are possible, that is, when one or the other of the cut portions 112 and 114 are cut and when neither are cut. According to the cut pattern, one of three digital signals 01, 10, or 00 is outputted across the signal lines 122, 124 to the CPU 150. After determining the type of digital signal, the CPU 150 retrieves a drive voltage corresponding to the determined digital signal from a table stored in a RAM, for example, of the recording device.

SUMMARY OF THE INVENTION

As described above, the conventional circuit sets drive voltage by outputting a digital signal to the CPU 150 over a signal lines 122, 124. The CPU 150 then determines the type of digital signal and sets the drive voltage of the print head unit accordingly. However, with this configuration, when the number of head ranks is increased, the number of signal lines 122, 124 must also be increased. For example, three or more signal lines must be provided to set one of four or more ranks.

In order to increase the number of signal lines that connect the head and the control circuit, connection processes become more complicated and production costs increase. Also, when the number of ranks is increased, a high precision AD converter and the like are required to accurately distinguish between different ranks. Also, when a large number of ranks are provided, adverse influence of noise and the like also increases.

It is an objective of the present invention to overcome the above-described problems and to provide a printing device capable of automatically distinguishing rank characteristic of a print head mounted in the printing device without adverse influence from noise and the like, without requiring a high precision AD converter, and without requiring a number of signal lines for distinguishing between different rank characteristics even when a large number of rank characteristics are provided for print heads.

In order to achieve the above-described objectives, a printing device according to the present invention includes: a signal input line over which signals are inputted to the print head mounted in the printing device; a delay time detection line connected to the signal input line, the delay time detection line including a delay circuit having at least one capacitor and at least one resistor, at least one of the at least one capacitor and at least one resistor delaying signals inputted over the delay time detection line in a manner changeable according to the rank characteristic of the print head; and a control unit for distinguishing rank characteristic of the print head. The control unit includes; an output unit that outputs a distinction signal over the signal input line; a detection unit that receives a delay signal inputted to the control unit from the delay time detection line via the signal input line, the detection unit using the delay signal to detect a delay time which the delay circuit delays the delay signal compared to the distinction signal; and a distinguishing unit that distinguishes rank characteristic of the print head based on the delay time detected by the detection unit.

With this configuration, a signal for distinguishing rank characteristic is outputted from the control unit over the signal input line. The control unit determines delay time between when this signal is outputted and when a signal is inputted to the control unit via the delay time detection line. The control unit can automatically distinguish the rank characteristic of the print head based on the delay time. Therefore, the rank characteristic can be distinguished using a simple configuration without increasing the number of detection lines even if the number of rank characteristics increases. With this configuration. even if the number of rank characteristics of print heads is greatly increased, the number of delay time detection lines extending to the control unit need not be increased.

According to another aspect of the present invention, the resistance value of the delay circuit is settable according to the rank characteristic of the print head. With this configuration, the rank characteristic can be easily distinguished using a simple manipulation for changing the resistance.

According to another aspect of the present invention, the delay circuit has at least two resistors, at least one of the at least two resistors being selectively brought into parallel connection with another of the at least two resistors to set resistance value according to rank characteristic of the print head. With this configuration, rank characteristic can be easily distinguished by using a simple configuration wherein resistors are selectively used to influence the delay time according to rank characteristic of the print head.

According to another aspect of the present invention, the rank characteristic is distinguished according to capacitance of the at least one capacitor of the delay circuit. With this configuration, the rank characteristic can be easily distinguished by simple operations for setting capacitance according to rank characteristic of the print head.

According to another aspect of the present invention, the delay circuit includes at least two capacitors, the at least two capacitors being selectively connected with ground to set capacitance according to rank characteristic of the print head. With this configuration, the rank characteristic can be easily distinguished by a simple configuration and by merely switching capacitors according to the rank characteristic of the print heads.

According to another aspect of the present invention, the rank characteristic of an ink-jet print head is automatically distinguished so that drive control of the ink-jet print head can be performed accordingly. Therefore, even if the ink-jet print heads are produced with a great variation in rank characteristics, printers can be produced that have uniform print quality.

In a method according to the present invention for automatically distinguishing a rank characteristic of a print head mounted in a printing device, the method includes the steps of; connecting a delay time detection line to a signal input line, the delay time detection line including a delay circuit having at least one capacitor and at least one resistor, at least one of the at least one capacitor and at least one resistor delaying signals inputted over the delay time detection line in a manner changeable according to the rank characteristic of the print head; applying a distinction signal over the signal input line; detecting a delay signal outputted from the delay time detection line via the signal input line and determining a delay time of the delay signal compared to application of the distinction signal; and automatically distinguishing rank characteristic of the print head based on the delay time.

According to this method, the delay time detection line extends from a signal input line for driving the print head. Therefore, when the distinction signal for distinguishing rank characteristic of a mounted print head is applied to the signal input line, the delay signal is outputted from the delay time detection line. Because the delay time detection line includes a delay circuit formed form a capacitor and a resistor, a delay time is generated between when the distinction signal is outputted to the signal input line to when the delay signal is outputted from the delay time detection line. The rank characteristic of the print head can be automatically determined based on the delay time.

In this way, by detecting the delay time, rank characteristic of the print head can be automatically distinguished. For this reason, even if the number of the rank characteristic of the print heads are increased, the number of the signal lines for distinguishing different ranks need not be increased. Therefore, the configuration for distinguishing rank characteristic is simple. Also, there is no need to provide a high precision AD converter and the like. Further, with this configuration, the determination of rank characteristic will not be affected by noise and the like.

According to another aspect of the present invention, the above-described distinction method is used to distinguish rank characteristic of an ink jet print head. Therefore, even if a great deal of variation is seen in ink jet print heads during their manufacture so that a great number of ranks are generated, rank characteristics of these ink jet print heads can be automatically distinguished without increasing the number of delay time detection lines from a control device for distinguishing the rank characteristic.

According to still another aspect of the present invention, a printing device includes; an output unit that outputs a distinction signal; a delay time detection line that receives input of the distinction signal, the delay time detection line including a delay circuit that delays the distinction signal in a manner changeable according to the rank characteristic of the print head, the delay time detection line outputting a delay time signal resulting from the distinction signal being delayed by the delay circuit; a detection unit that receives the delay signal from the delay time detection line, the detection unit using the delay signal to detect a delay time which the delay circuit delays the delay signal compared to the distinction signal; and a distinguishing unit that distinguishes rank characteristic of a print head mounted in the printing device based on the delay time detected by the detection unit.

BRIEF DESCRIPTION OF THE DRAWINGS

The above and other objects, features and advantages of the invention will become more apparent from reading the following description of the preferred embodiment taken in connection with the accompanying drawings in which:

FIG. 4(*b*) is a plan view showing the chip on board of FIG. 4(*a*);

FIG. 4(*c*) is a side view showing the chip on board of FIG. 4(*a*);

FIG. 10(A) is a table for determining rank based on drive voltage necessary to perform predetermined operations of the print head;

FIG. 10(B) is a table showing drive voltage required to drive each rank of the print head in a particular operating ambient temperature;

DETAILED DESCRIPTION OF THE PREFERRED EMBODIMENTS

Figure 1:
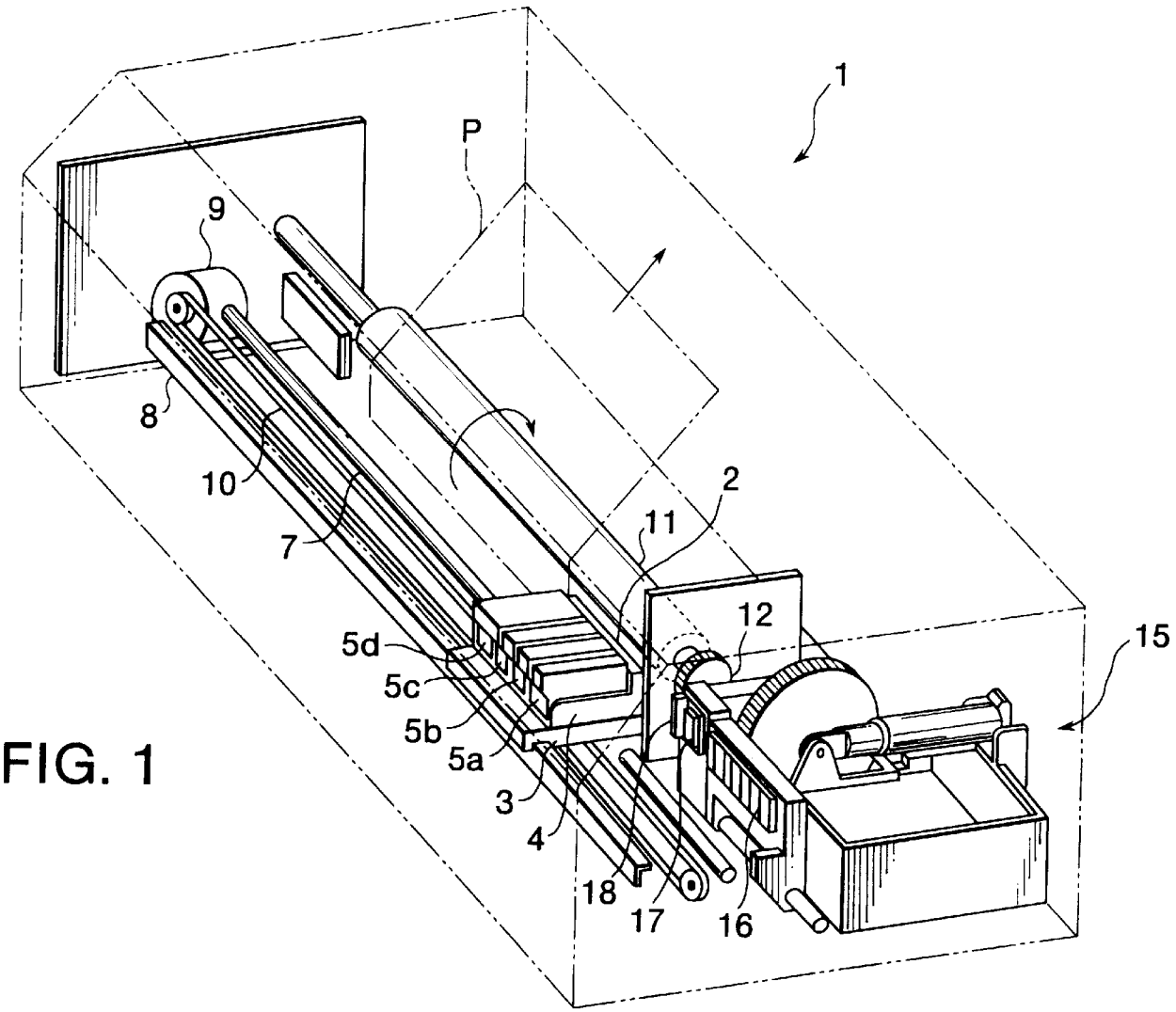
FIG. 1 is a perspective view partially in phantom showing a printing device according to the embodiment of the present invention.

A printing device according to a preferred embodiment of the present invention will be described while referring to the accompanying drawings wherein like parts and components are designated by the same reference numerals to avoid duplicating description.

FIG. 1 is a perspective view schematically showing a color ink jet printer 1. The printer 1 includes an ink-jet print head 2 for ejecting four different colors of ink, that is, cyan, magenta, yellow, and black, onto a recording medium P to print characters, symbols. and the like. The print head 2 is formed with four head chips 2*a* to 2*b*, each including a set of nozzles for ejecting one of the four different colored inks. The print head 2 is integrally provided to a head unit 4. Ink cartridges 5*a*, 5*b*, 5*c*, and 5*d* are detachably mounted on the carriage 3. The ink cartridges 5*a* to 5*d* are for supplying the four different colored inks to corresponding nozzles of the print head 2. A carriage shaft 7 and a guide plate 8 are disposed in parallel extending along the width of the printer 1. During printing, the print head 2 is supported on a carriage 3, which is mounted on the carriage shaft 7 and whose rear portion is freely, slidably supported on the guide plate 8. A motor 9 is provided for driving the carriage 3. A belt 10 connects the motor 9 with the carriage 3 so that driving force of the motor 9 is transmitted to reciprocally move the carriage 3. With this configuration, the carriage 3 can be driven by the motor 9 to reciprocally and linearly move following the carriage shaft 7.

A platen roller 11 is provided extending in the same direction as the carriage shaft 7 and the guide plate 8. The platen roller 11 is provided at a position confronting the print head 2. The platen roller 11 is driven by a line feed motor (not shown in the drawings) via a platen gear 12. The platen roller 11 transports the recording medium P to a position confronting the print head 2, whereupon printing is performed.

A purge unit 15 and a capping unit 16 for protecting the print head are provided at a side of the platen roller 11. The purge unit 15 includes a suction cap 17. Bubbles generated in the nozzles of the print head 2 and ink droplets clinging to the ejection surface of the print head 2 can cause the print head 2 to defectively eject ink. In order to prevent such defective ejection and bring the print head 2 back into a good ejection condition, the suction cap 17 is placed over the print head 2 and ink is sucked from the nozzles. The capping unit 16 is for preventing ink on the ejection surface and in the nozzles from drying up. When the printer 1 is not being used to print, the carriage 3 is moved to its capping position in front of the capping unit 16 and nozzles are covered by the capping unit 16. A wiper 18 is provided next to the suction cap 17 for wiping the nozzles of the print head 2.

Figure 2:
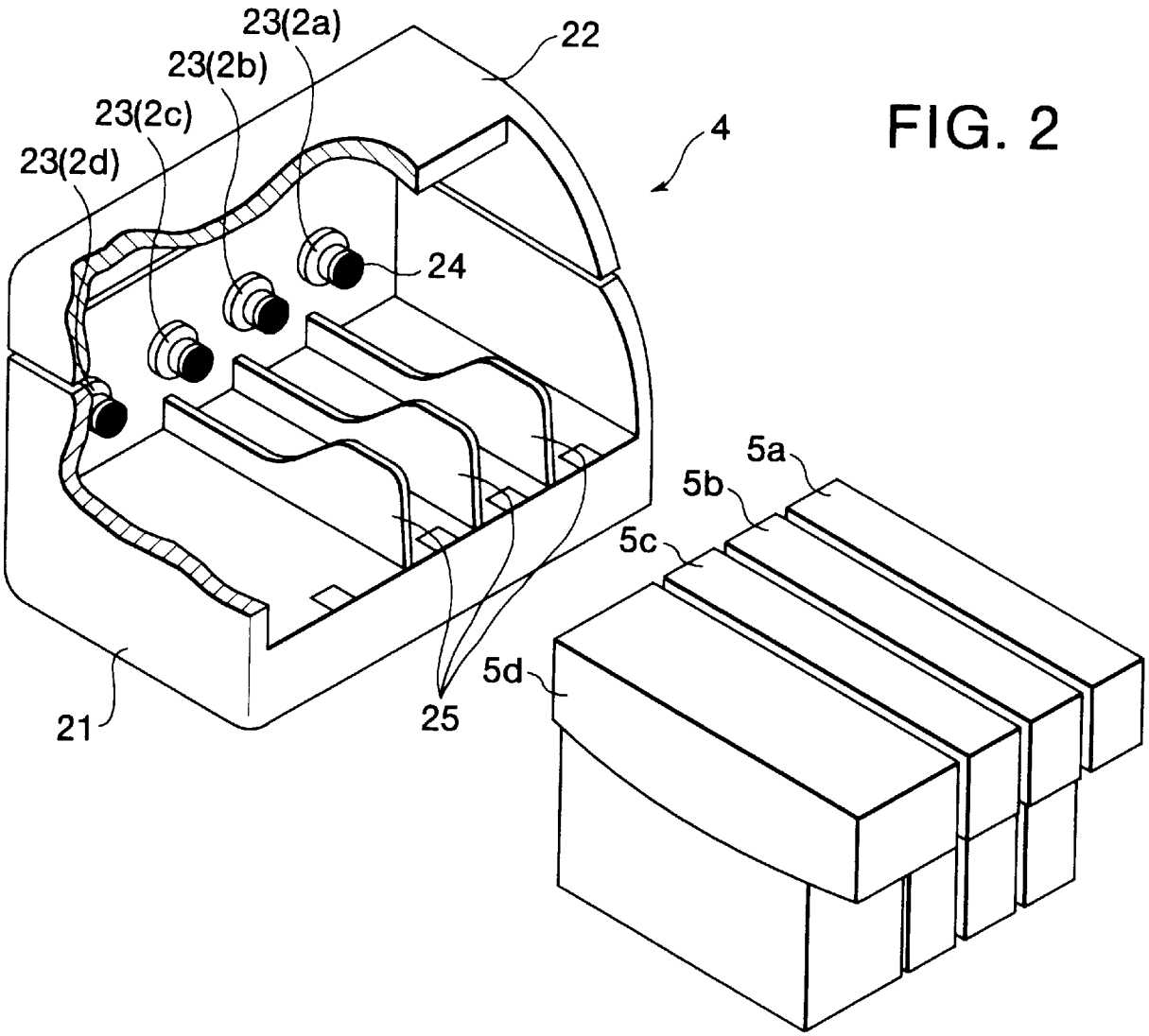
FIG. 2 is a perspective view in partial cross section showing a head unit of the printing device.

FIG. 2 is a perspective view in partial cross section showing the head unit 4 including the print head 2. As shown in FIG. 2, the frame of the head unit 4 includes a holder 21 and a cap 22. Ribs 25 are provided in the holder 21 to divide the holder 21 into four different spaces, one for each ink cartridge 5*a* to 5*d*.

Figure 3:
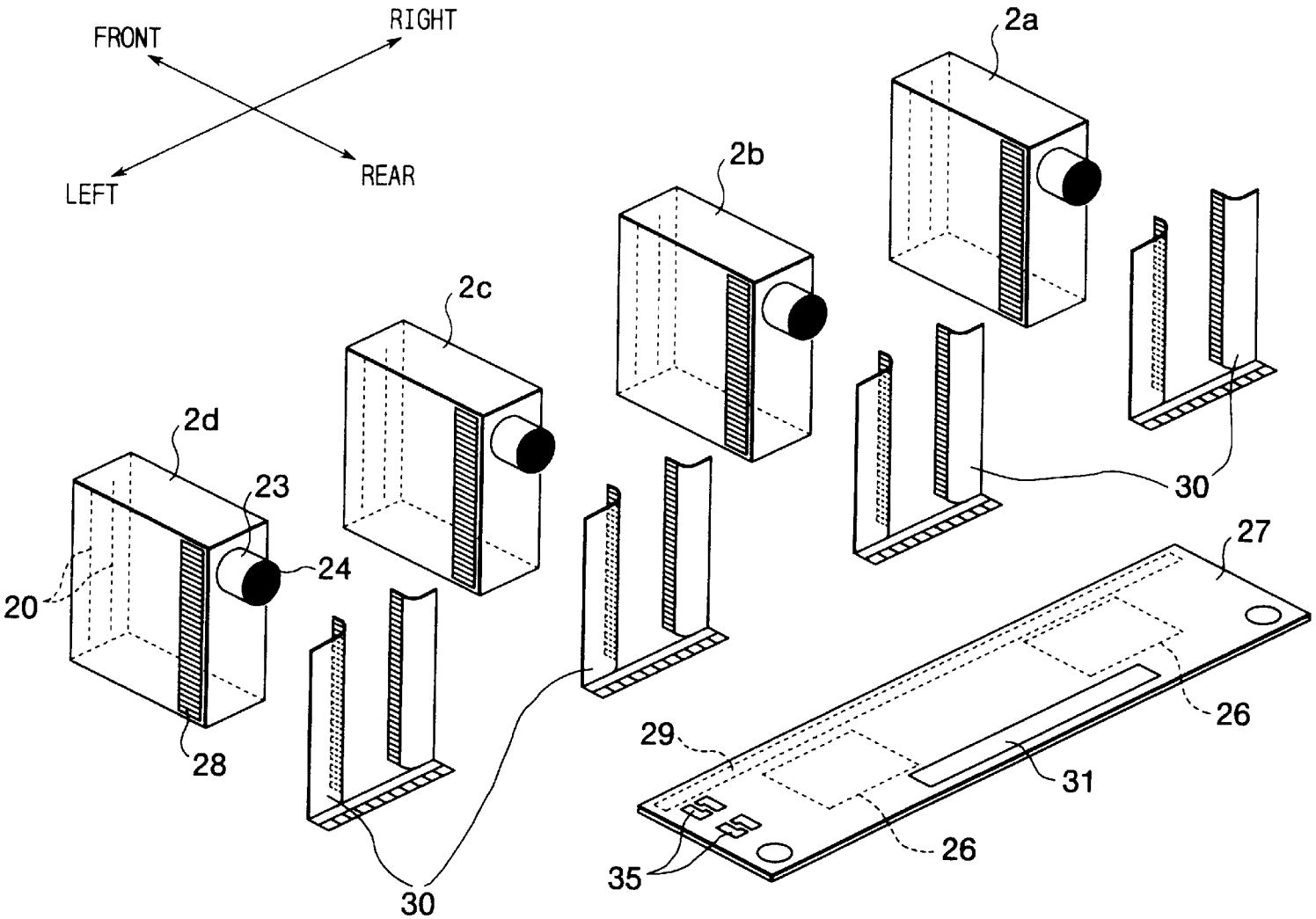
FIG. 3 is an exploded view showing the print head and components connected thereto.

FIG. 3 is an exploded view showing the print head 2 and components connected thereto. As shown in FIG. 3, the print head 2 mounted on the head unit 4 includes head chips 2*a*, 2*b*, 2*c*, and 2*d*. An ink manifold 23 is formed on one side of each head chip 2*a* through 2*d*. A filter 24 for removing foreign matter from the ink supply channel to the nozzles 20 is provided at an open end of the ink supply channel of the ink manifold 23.

As shown in FIG. 2, the head chips 2*a*, 2*b*, 2*c*, and 2*d* are aligned along the front surface of the holder 21 so that the ink manifold 23 for each head chip 2*a* through 2*d* penetrates through the front wall of the frame. When the four different ink cartridges 5*a* to 5*d* are mounted in the spaces divided by the ribs 25, the ink supply ports of the ink cartridges are brought into fluid connection with the ink manifold 23, so that ink from the ink cartridges 5*a* to 5*d* can be supplied to corresponding ones of the head chips 2*a* to 2*d*.

As shown in FIG. 3, each head chip 2*a*, 2*b*, 2*c*, and 2*d* is formed with a set of nozzles 20 for independently ejecting its corresponding one of the different four colored inks. Each head chip 2*a*, 2*b*, 2*c*, and 2*d* includes piezoelectric ceramic elements for generating mechanical energy to eject ink. The piezoelectric ceramic elements form ink channels. Application of voltage to the piezoelectric elements deforms the piezoelectric elements and changes the volume in the ink channels so that ink supplied from the ink cartridges 5*a* to 5*d* is ejected from the corresponding set of nozzles 20. The head chips 2*a* to 2*d* are formed so as to be mounted on a circuit on board (COB) 27.

Figure 4:
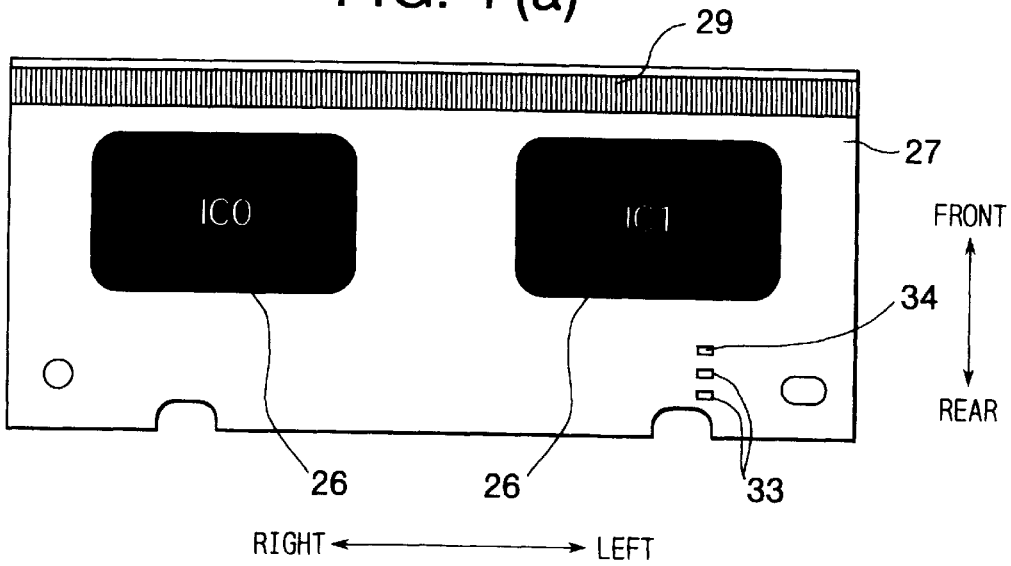
FIG. 4(*a*) is an underside view showing a chip on board according to the present embodiment.
Figure 4:
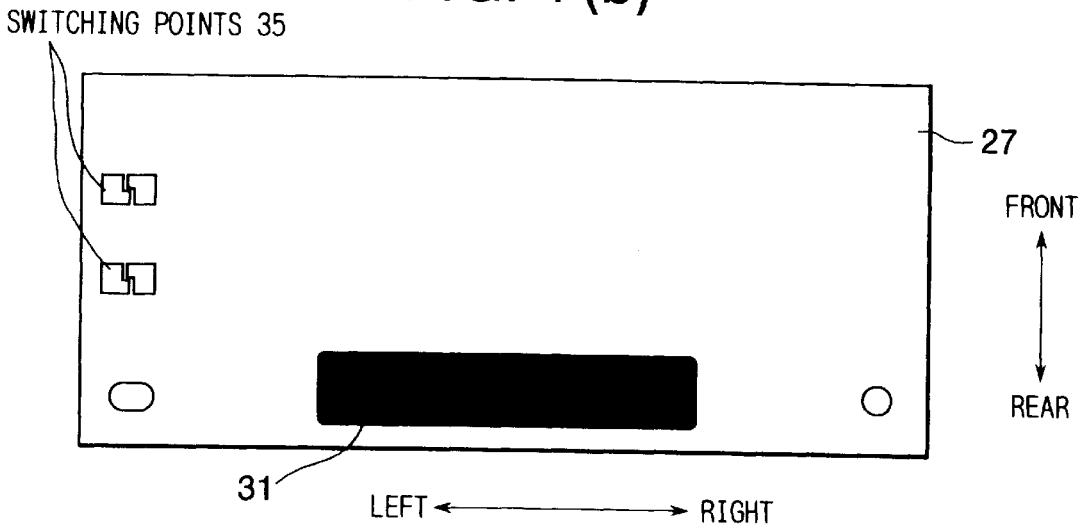
Figure 4:
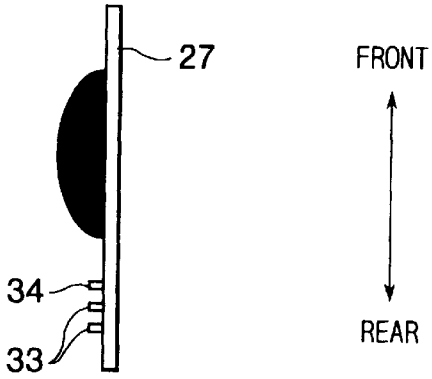

Next, the COB 27 will be described while referring to FIGS. 3 and 4(*a*) to 4(*c*). The COB 27 is disposed on the lower surface of the head unit 4. Driver circuits (driver IC) 26 for driving print head 2 are mounted on the COB 27. The COB 27 is also provided with output electrodes 29 for electrically connecting the COB 27 with the head chips 2*a* to 2*d*. An input portion 31 of the COB 27 is provided for connecting a variety of lines for inputting control signals and the like from the control unit of the printer 1 to the COB 27. Flexible printing cables (FPC) 30 are provided for connecting the electrodes 28 provided on the side of the head chips 2*a* to 2*d* with the output electrodes 29 of the COB 27.

Figure 6:
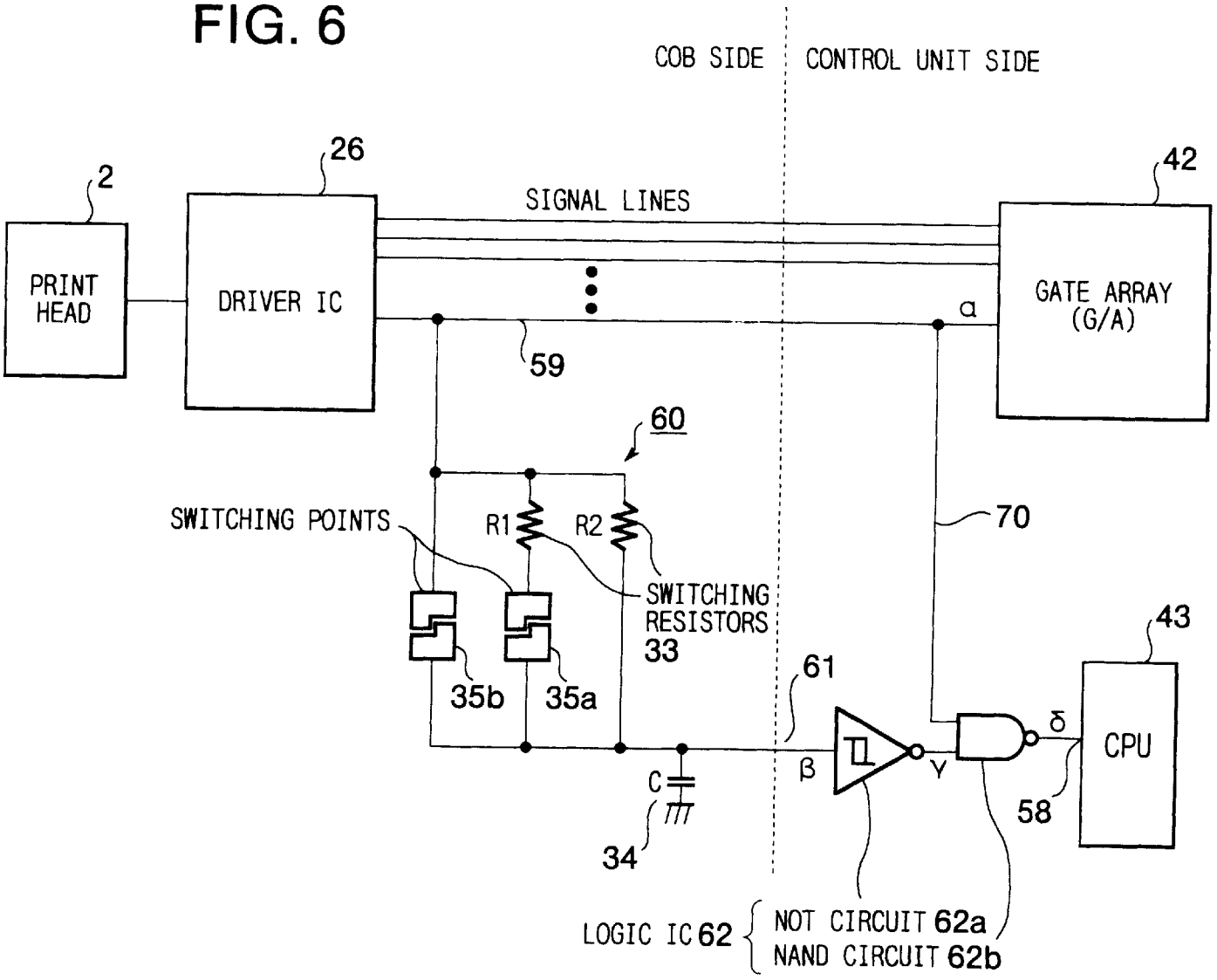
FIG. 6 is a block diagram showing details of circuitry for distinguishing the print head mounted in the printing device.

According to the present invention, the print head 2 has a rank characteristic that is known before the print head 2 is mounted in the printer 1. To enable the control unit to distinguish rank characteristic of the print head 2, a delay circuit 60 shown in FIG. 6 is provided to the COB 27. As shown in FIG. 6, the delay circuit 60 includes a capacitor 34 and resistors 33. By switching the resistors 33 that effect the resistance of the delay circuit 60, the resistance of the delay circuit 60 can be changed at time of assembly according to rank characteristic of the mounted print head 2. As will be described later, the resistors 33 can be switched by selectively closing the switching points 35*a*, 35*b* so that either or both is in an electrically continuous condition, or by leaving both switching points 35*a*, 35*b* open.

Figure 5:
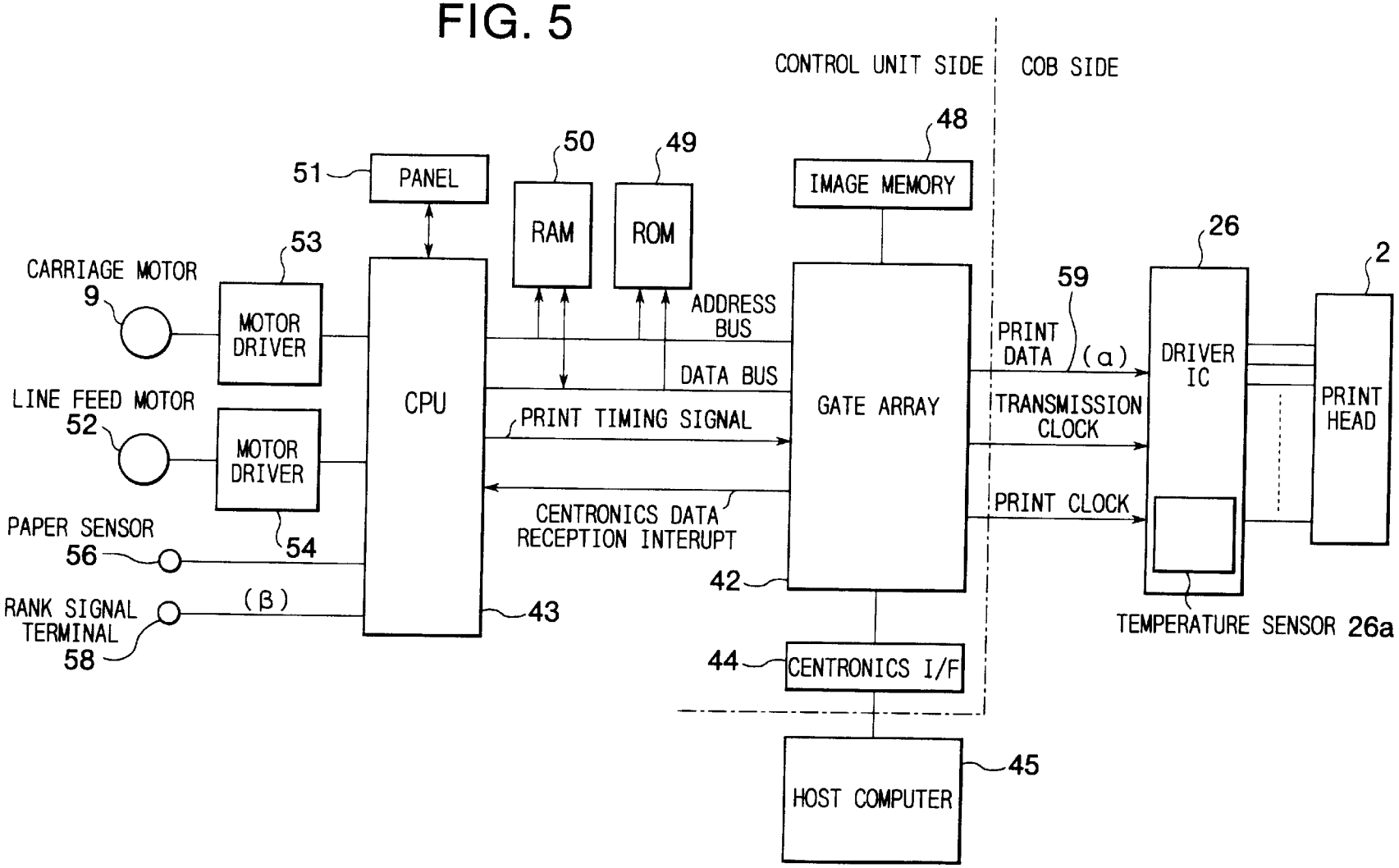
FIG. 5 is a block diagram showing electrical configuration of the printing device of the present embodiment.

FIG. 5 is a block diagram showing the control unit of the printer 1. The printer 1 includes a gate array circuit 42 for controlling printing operations for printing print data and the like, and a CPU 43 made from a single micro chip computer for performing overall control of the printer 1. An interface portion 44, such as a Centronics interface, is provided for connecting the gate array circuit 42 to a host computer 45. An image memory 48 for storing image data received from the host computer 45 is also connected to the gate array circuit 42. The gate array circuit 42 and the CPU 43 are connected to a ROM 49 storing control programs, such as for controlling drive mechanism of the carriage 3 and the transport mechanism for the recording medium P, and to a RAM 50 for storing control data for controlling the various components of the printer 1. The CPU 43 is connected to a variety of components, such as; an operation panel 51 including a variety of operation switches; motor driver circuits 53, 54 for driving the motor 9 and a line feed motor 52, respectively; and a paper sensor 56 for detecting whether or not the recording medium P is at the print position. A rank signal terminal 58 is provided to the CPU 43.

The print head 2 is connected to the gate array circuit 42 via the driver IC 26 and a variety of control signal lines, such as a print data signal line 59. In order to eject ink from nozzles of the print head 2 and print characters and the like on the recording medium P, signals, such as print data signals, transmission clock signals, and print clock signals for driving the print head 2 are outputted from the gate array circuit 42 over the control signal lines. A temperature sensor 26*a* for detecting temperature of the print head 2 is provided internally in the driver IC 26. The temperature sensor 26*a* outputs a temperature detection signal to the gate array circuit 42. The gate array circuit 42 controls drive voltage and frequency outputted by the driver IC 26 based on the temperature detection signal from the temperature sensor 26*a*.

As will be described in further detail later, the gate array circuit 42 on the control unit side outputs a distinction signal, which is for distinguishing rank characteristic of the mounted print head 2 over one of the control signal lines, such as the print data signal line 59. When the distinction signal is outputted over the print data signal line 59, then a signal is obtained via the delay circuit 60 shown in FIG. 6. The obtained signal is inputted to the rank signal terminal 58 of the CPU 43. In this way, the gate array circuit 42 serves as a unit for outputting a distinction signal and the CPU 43 serves as a unit for detecting the signal and distinguishing the rank of the print head accordingly.

FIG. 6 is a circuit diagram representing configuration used for distinguishing rank characteristic of the print head 2. The input signal line 59 extends between the driver IC 26 and the gate array 42. A delay time detection line 61 is connected between the input signal line 59 and the rank signal terminal 58 of the CPU 43, which is on the control unit side. The delay circuit 60 is disposed on the delay time detection line 61 on the COB side. A logic IC 62 is disposed on the delay time detection line 61 on the control unit side.

Here an explanation will be provided for the delay circuit 60. The delay circuit 60 is a circuit formed from the capacitor 34 and the two resistors 33. The resistors 33 include resistors R1 and R2. The resistor R1 has a lower resistance that the resistor R2. The delay circuit 60 includes three lines connected in parallel; one line connected to the resistor R1, one line connected to the resistor R2, and one line provided with no resistor. The line including the resistor R1 also is provided with a switching point 35*a*. The line provided with no resistor is provided with a switching point 35*b*. The switching points 35*a* and 35*b* each have two portions electrically disconnected from each other. However, as shown in FIG. 4(*b*), the switching points 35*a* and 35*b* are exposed from the back surface of the COB 27 so that the electrically disconnected portions can be easily brought into electrical connection, for example, by application of a drop of solder. A capacitor 34*c* is connected in series with the three parallel lines.

Here, an explanation will be provided for the logic IC 62. The logic IC 62 is formed from a NOT circuit 62*a* and a NAND circuit 62*b*. The NOT circuit 62 inverts inputted signals and also converts inputted analog signals into digital signals. The input terminal of the NOT circuit 62*a* is connected, via the delay time detection line 61, to the nodes of the resistors and the capacitors of the delay circuit 60. The output terminal of the NOT circuit 62*a* is connected to one of the input terminals of the NAND circuit 62*b*. The other input terminal of the NAND circuit 62*b* is connected to the print data signal line 59 via a line 70. The output terminal of the NAND circuit 62*b* is connected, via the delay time detection line 61, to the rank signal terminal 58 of the CPU 43.

With this configuration, when a distinction signal $\alpha$ is outputted from the gate array 42 over the print data signal line 59, then an analog signal $\beta$ is outputted from the node of the delay circuit 60 to the NOT circuit 62*a*. The waveform of the analog signal $\beta$ is determined by the connection condition of the switching points 35*a*, 35*b* as will be described later. When inputted with the analog signal $\beta$, the NOT circuit 62*a* outputs a digital signal Y as a result. The signal Y from the NOT circuit 62*a* is outputted to one terminal of the NAND circuit 62*b*. The distinction signal $\alpha$ outputted from the gate array circuit 42 is also inputted to the other terminal of the NAND circuit 62*b* via the line 70. The NAND circuit 62*b* outputs a signal $\delta$ to the rank signal terminal 58 of the CPU 43 depending on the state of the distinction signal $\alpha$ and the signal Y.

Figure 7:
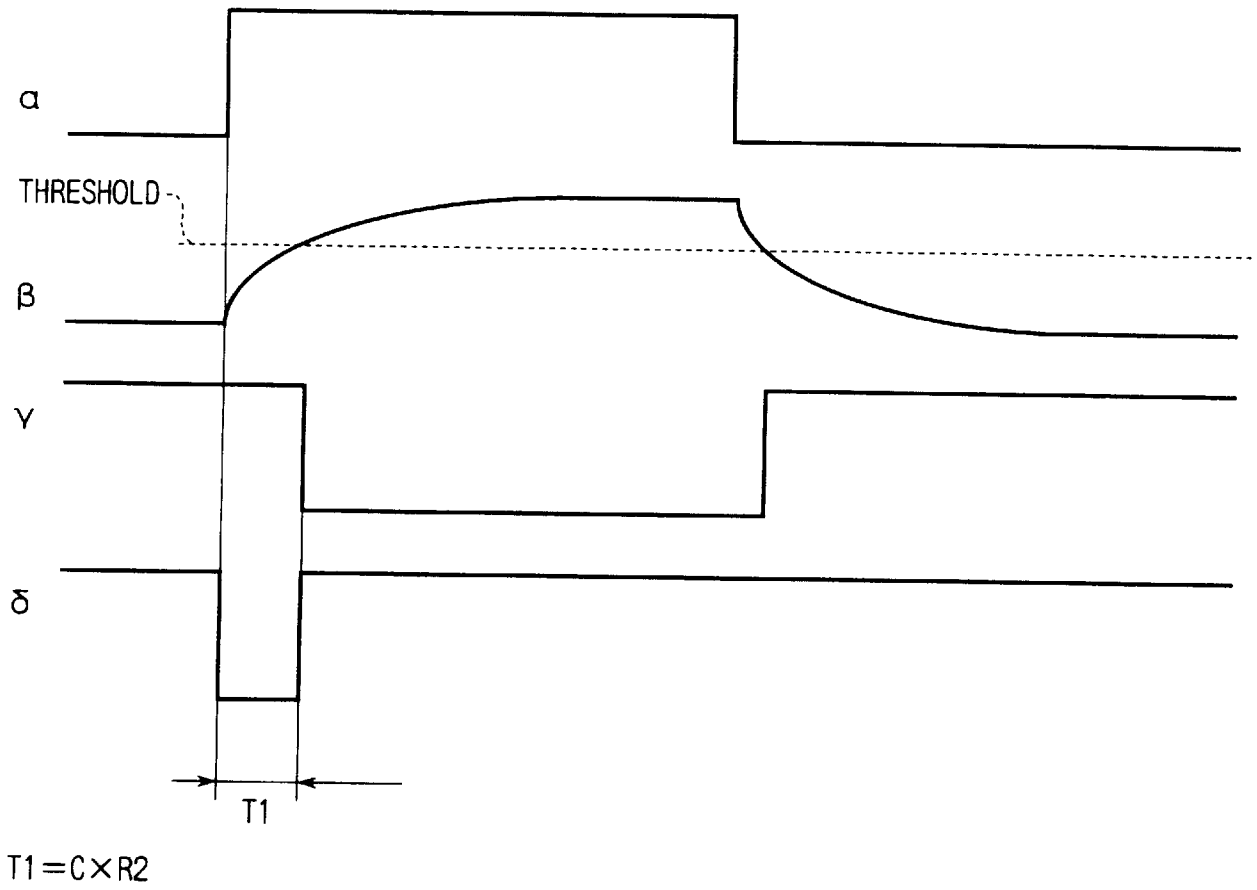
FIG. 7 is a waveform chart showing waveforms of various signals when both switching points of the circuit on board of FIG. 4(*a*) are left open.
Figure 8:
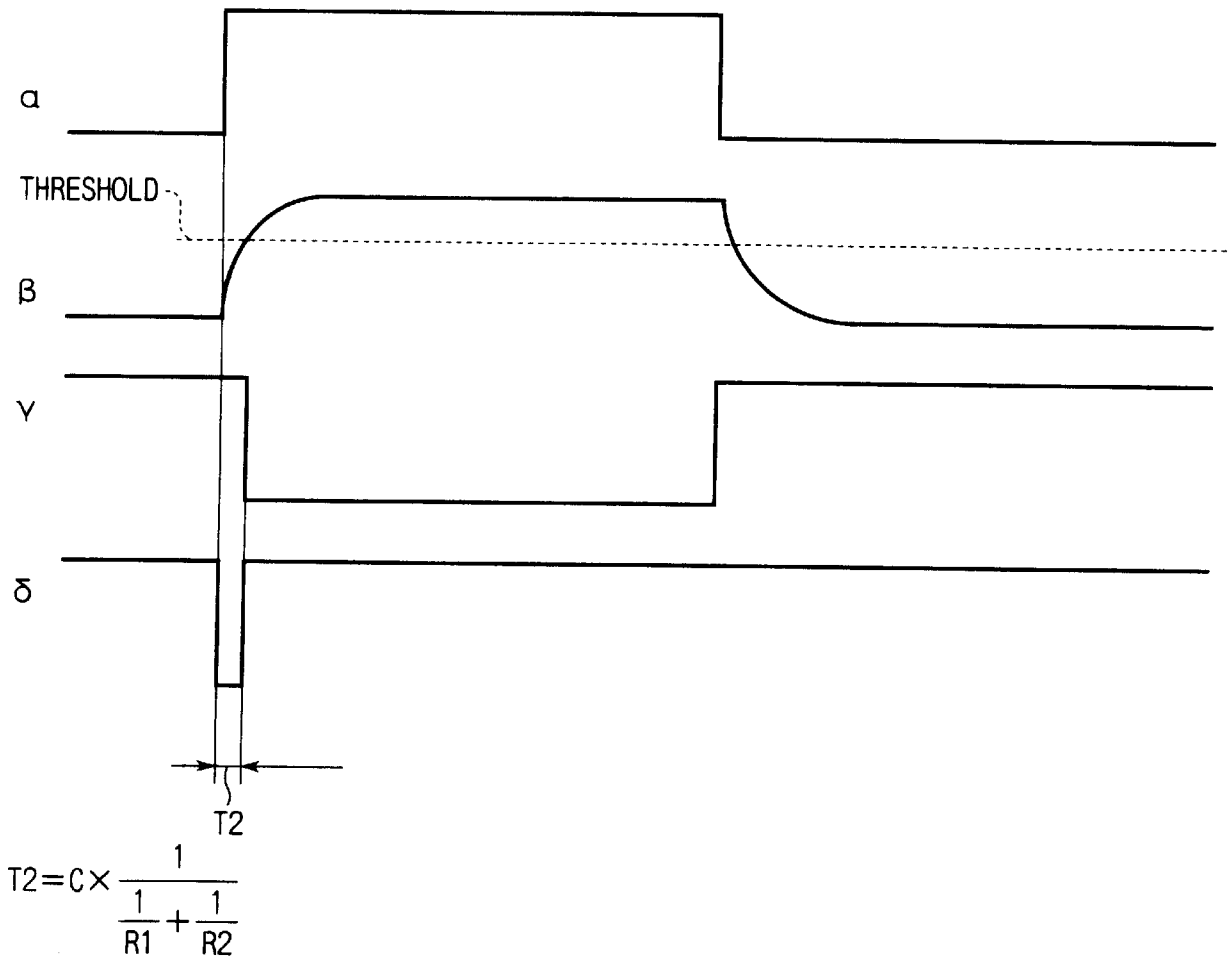
FIG. 8 is a waveform chart showing waveforms of the signals when only one of the switching points of the circuit on board left is connected.
Figure 9:
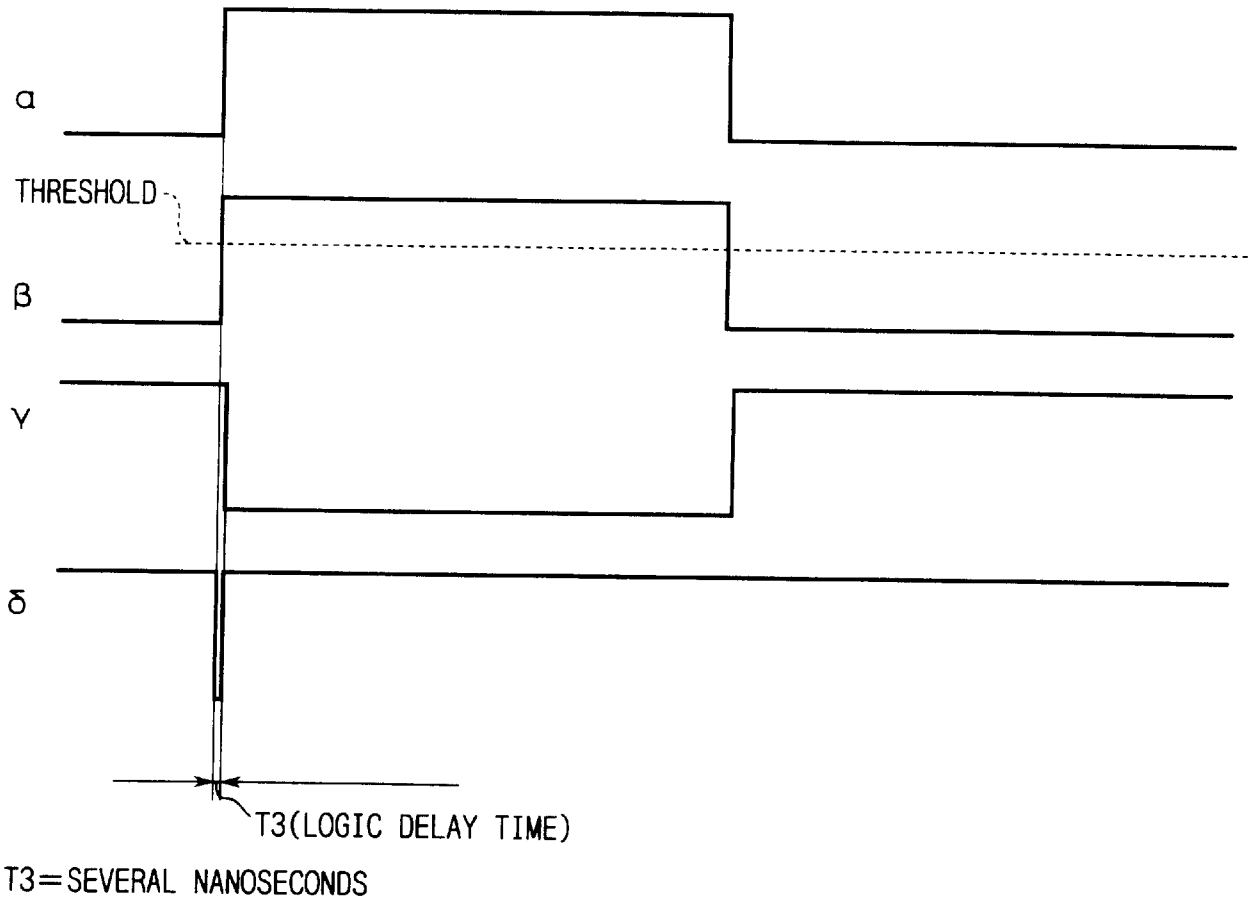
FIG. 9 is a waveform chart showing waveforms of the signals when a different one of the switching points of the circuit on board left is connected.

Next, while referring to the waveform charts shown in FIGS. 7, 8, and 9, an explanation will be provided for changes in the waveforms of the analog signal $\beta$ and the signals Y and $\delta$ resulting from different connection conditions of the switching points 35*a*, 35*b*. FIG. 7 shows waveforms of signals produced when both the switching points 35*a*, 35*b* provided to the COB 27 are left open. FIG. 8 shows waveforms of signals produced when the switching point 35*a* only is closed. FIG. 9 shows waveforms of signals produced when the switching point 35*b* only is closed.

When a print head 2 with known rank characteristic is mounted in the printer 1, a distinction signal $\alpha$ is outputted from the gate array 43 to the driver IC 26 over the print data signal line 59. It should be noted that when the distinction signal $\alpha$ is outputted over the print data signal line 59, and not over a signal line exclusively for the distinction signal $\alpha$, other signals, such as for driving the print head 2, must not be outputted over the print data signal line 59 at this time. Resultant current will flow from the data signal line 59 to the delay time detection line 61 and pass through the delay circuit 60 in a manner dependent on which of the switching points 35*a*, 25*b* if any are closed. The analog signal $\beta$ will be outputted at a timing delayed from initial output of the distinction signal $\alpha$ by an amount dependent on which of the switching points 35*a*, 25*b* if any are closed.

For example. in the case when both the switching points 35*a* and 35*b* are left open, the current will flow through the switching resistor R2 to the capacitor 34. As shown in FIG. 7, when the capacitor 34 begins to charge, the voltage of analog signal $\beta$ will increase. The threshold for analog to digital conversion performed by the NOT circuit 62*a* is indicated by a dotted line in FIG. 7. When the voltage of analog signal $\beta$ reaches the threshold, the signal Y outputted by the NOT circuit 62*a* will invert, as will the signal $\delta$ outputted from the NAND circuit 62*b*. The time from when the distinction signal $\alpha$ is outputted from the gate array 43 to when the signal $\delta$ outputted from the NAND circuit 62*b* inverts is referred to as delay time T1. Delay time T1 can be calculated according to the following formula:

T1=C×R2 wherein C is the capacitance of the capacitor 34; and

R2 is the resistance of the resistor R2.

In the case when only switching point 35*a* is closed, as shown in FIG. 8 a delay time T2 from when the distinction signal α is outputted from the gate array 43 to when the signal δ outputted from the NAND circuit 62*b* inverts can be calculated according to the following formula:

$$T2 = C \times \frac{1}{\frac{1}{R1} + \frac{1}{R2}}$$

wherein R1 is the resistance of the resistor R1.

In the case when only switching point 35*b* is connected as shown in FIG. 9, a delay time T3 from when the distinction signal α is outputted from the gate array 43 to when the signal δ outputted from the NAND circuit 62*b* is determined by the delay time of the circuitry itself and has a duration of only several nanoseconds.

The delay time T1 is greatest, delay time T2 is the next greatest, and delay time T3 is the least delayed. Data for distinguishing rank characteristic of the print head 2 based on these delay times T1, T2, and T3 is stored in the CPU 43. Accordingly, the CPU 43 is capable of distinguishing rank characteristic of the print head 2 presently mounted in the printer 1 based on this data on the detected delay time.

FIG. 10(A) is a table for determining rank based on drive voltage necessary to perform predetermined operations of the print head 2. FIG. 10(B) is a table showing drive voltage required to drive each rank of the print head in a particular operating ambient temperature. In this example, the print heads are divided into three ranks A, B, C, and a no good (NG) group for defective print heads. Print heads in rank A require a comparatively low drive voltage. Print heads in rank B require a standard drive voltage. Print heads in rank C require a comparatively high drive voltage. These ranks are determined based on the amount of voltage required to eject ink droplets from the print head 2 at a speed of five meters per second. The print heads 2 are categorized by rank by referring to the table in FIG. 10(B). Then, based on the print head 2 mounted in the printer 1, the switching points 35*a*, 35*b* are connected or left unconnected accordingly. The CPU 43 is inputted with information on this predetermined relationship between the switching points 35*a*, 35*b* and different ranks, so that after the CPU 43 distinguishes the rank of the mounted print head 2, it can appropriately control voltage applied to the print head 2 during printing operations so that appropriate printing operations can be performed.

According to the present embodiment, only a single signal line is required for distinguishing between different ranks of the print head 2. Therefore, even if the number of ranks are increased, the number of required signal lines does not need to be increased. The setting condition of the switching points 35*a*, 35*b* need only be changed according to the rank of the print head 2. In this way, the configuration is simple and operations are easy.

While the invention has been described in detail With reference to specific embodiments thereof, it would, be apparent to those skilled in the art that various changes and modifications may be made therein without departing from the spirit of the invention, the scope of which is defined by the attached claims.

Figure 11:
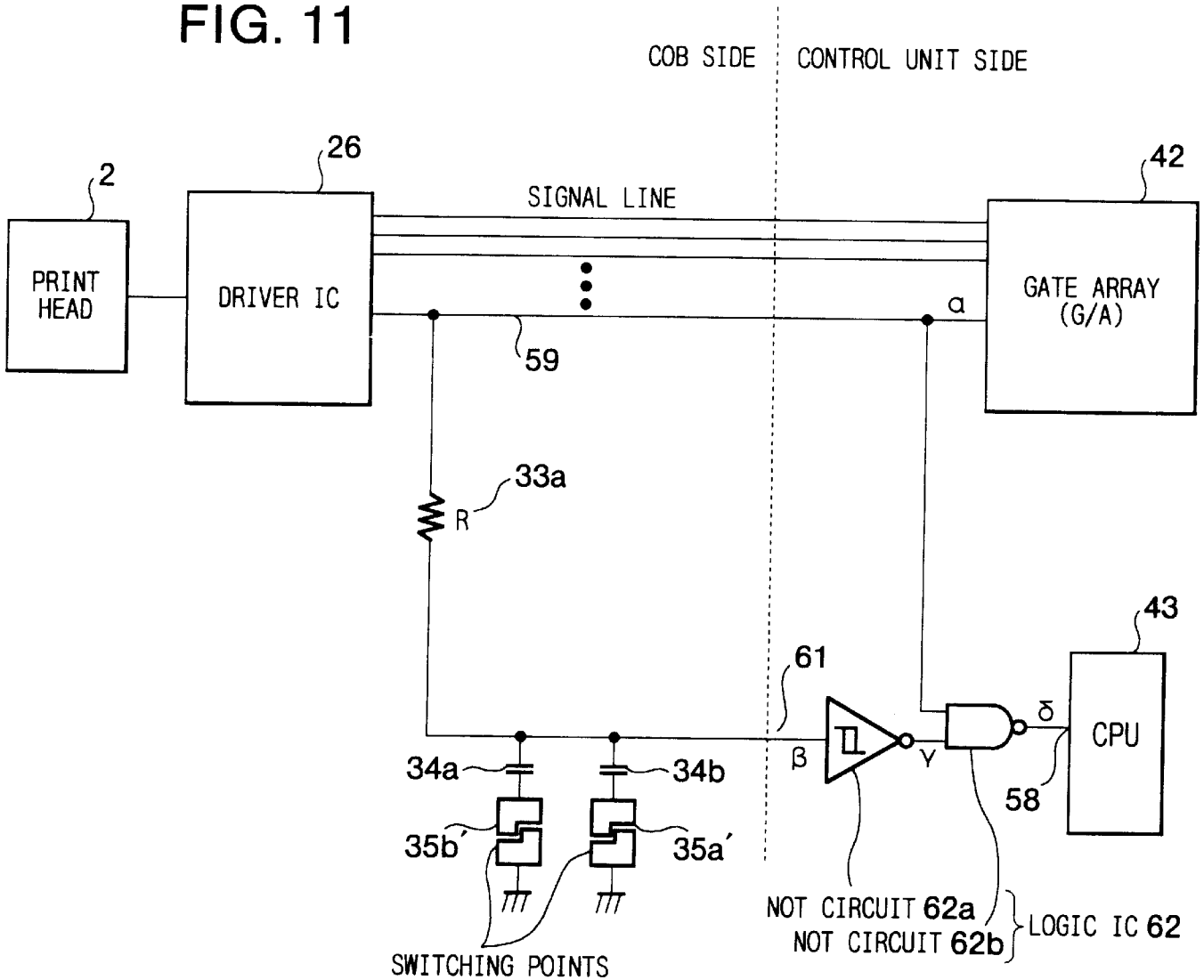
FIG. 11 is a block diagram showing a modification of the circuitry shown in FIG. 6.

For example, in the present embodiment, the rank characteristic of the mounted print head 2 is indicated to the CPU 43 by changing which, if any, of the plurality of resistances R1, R2 influence charge time of the single capacitor 34*c*. However, FIG. 11 shows a configuration for achieving the same effect by providing a single resistor 33*a* and two capacitors 34*a*, 34*b*. Switching points 35*a*' and 35*b*' are provided for selectively connecting the capacitors 34*a*, 34*b* to ground. The delay time from when the distinction signal α is outputted from the gate array 43 to when the signal δ is outputted from the NAND circuit 62*b* depends on the connection condition of the switching points 35*a*' and 35*b*'.

Figure 12:
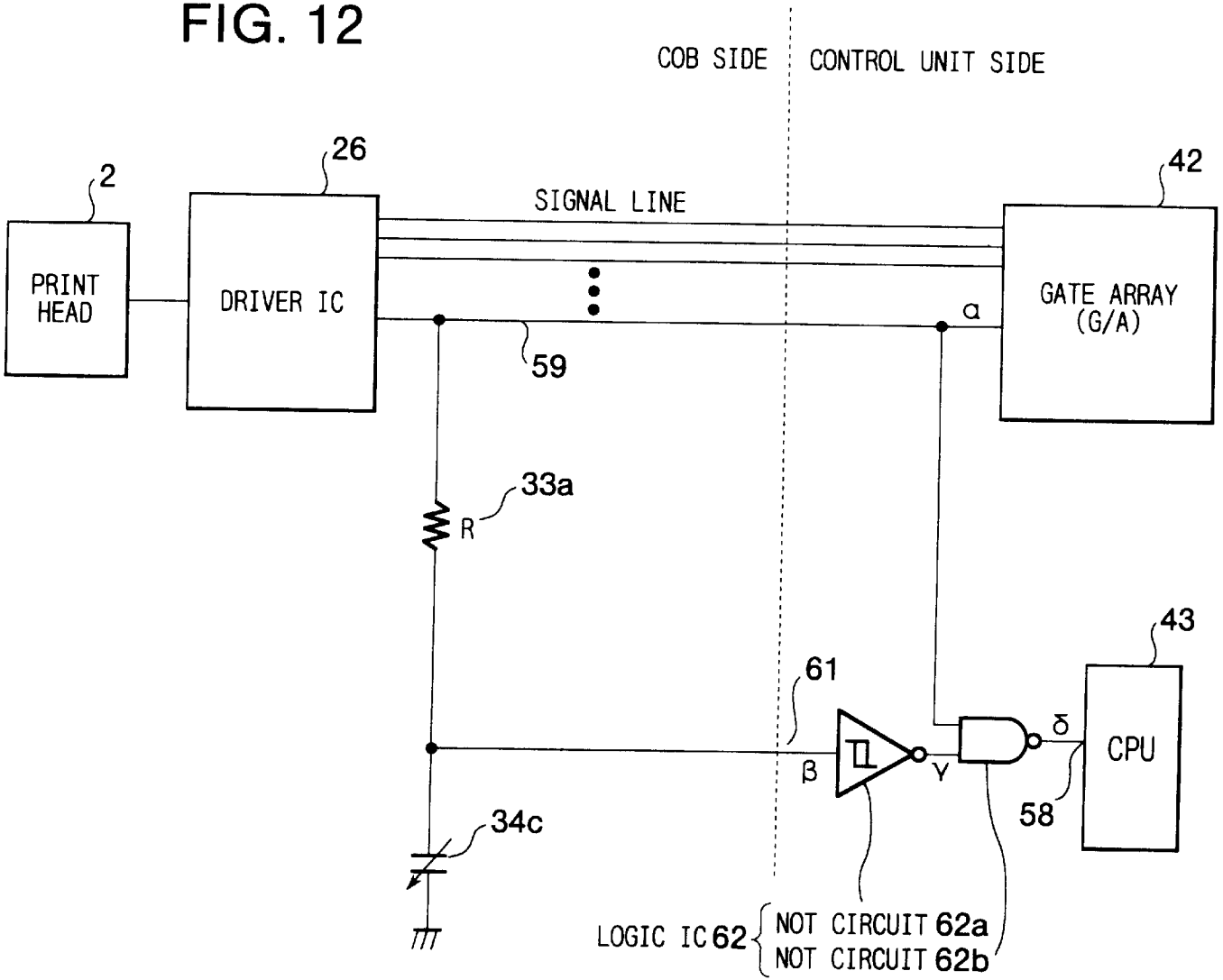
FIG. 12 is a block diagram showing another modification of the circuitry shown in FIG. 6.
Figure 13:
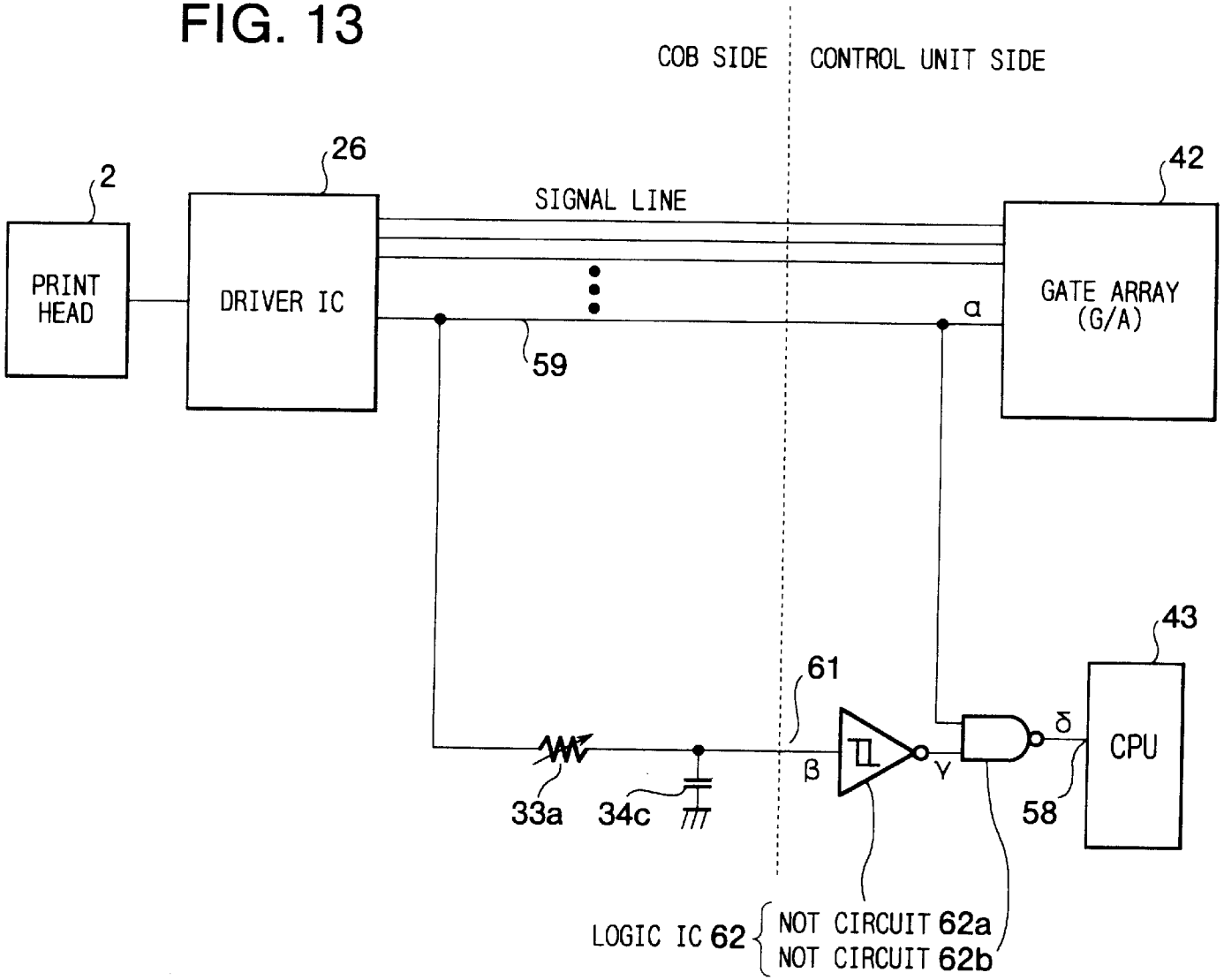
FIG. 13 is a block diagram showing still another modification of the circuitry shown in FIG. 6.
Figure 14:
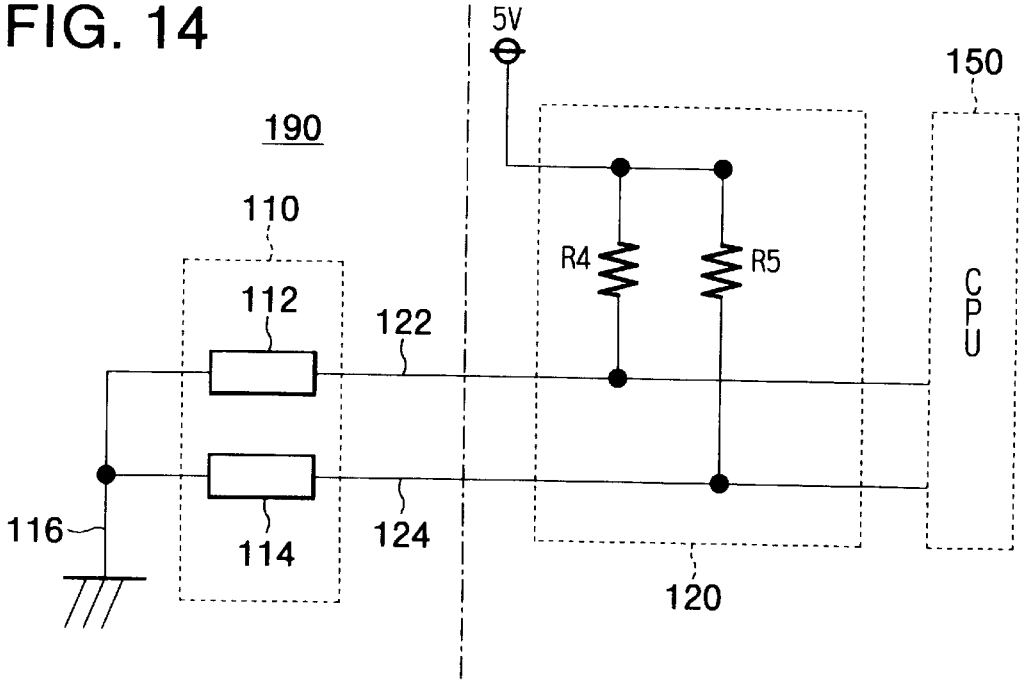
FIG. 14 is a block diagram showing a conventional configuration for distinguishing rank of a print head mounted in a printing device.
Figure 15:
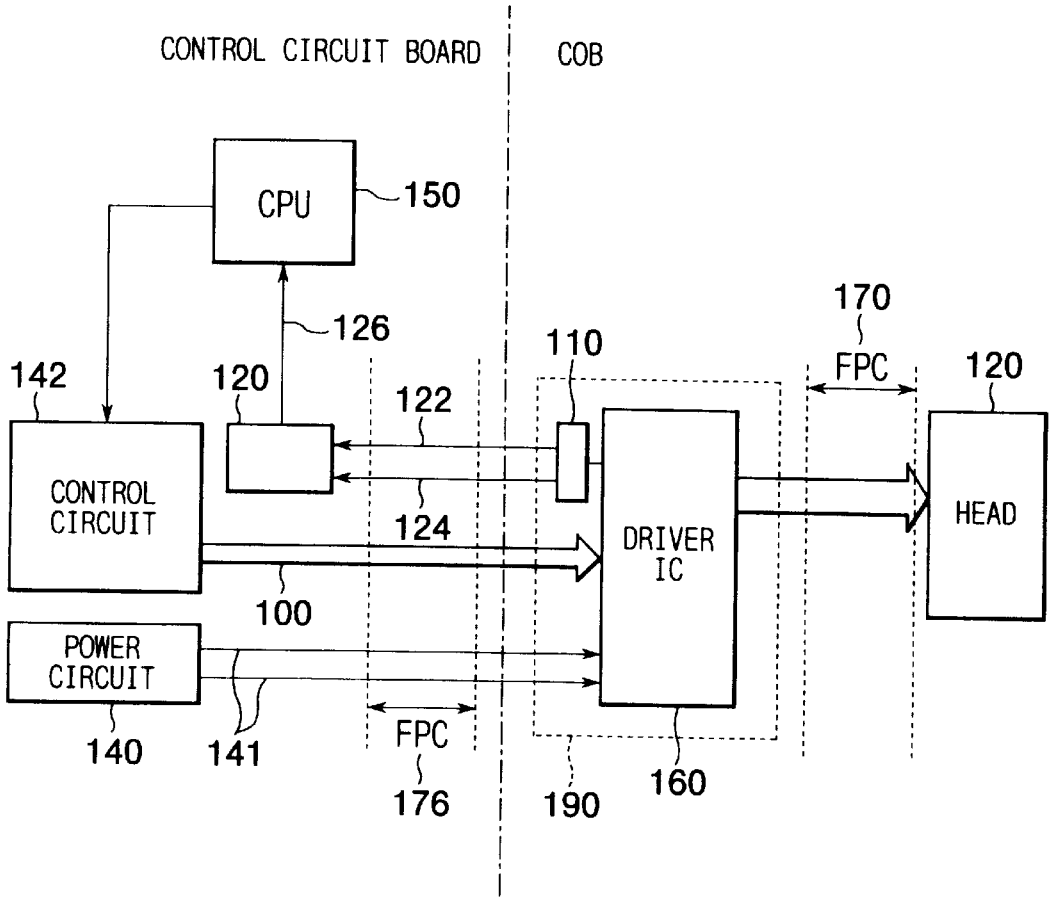
FIG. 15 is a block diagram showing electrical configuration of a conventional printing device including the configuration shown in FIG. 14.

Alternatively, as shown in FIG. 12, the single capacitance capacitors 34*a* and 34*b* could be replaced with a variable capacitor 34*c* with capacitance that can be changed according to the rank of the print head 2. In this case, the switching points 35*a*' and 35*b*' could also be dispensed with.

A variable resistor, such as a rheostat, can be provided on the COB 27 in place of the switching points 35*a*, 35*b* and the resistors R1 and R2. With this configuration, the resistor value can be appropriately set according to the rank of the presently mounted print head 2 by merely setting the variable resistor accordingly. In the example shown in FIG. 12. a variable resistor 33*a* and a single capacitor 34*c* are disposed on the delay time detection line 61.

The embodiment describes different print heads 2 as being categorized into three ranks. However, the print heads 2 can be divided into more than three ranks. However, even if the print heads 2 are divided into a greater number of ranks, the number of signal lines for distinguishing these ranks need not be increased.

Also, the delay circuit 60 could be connected to signal lines other than the print data signal line 59. For example, the delay circuit 60 could be connected to a transmission clock signal line or a print clock signal line. In these cases, the distinction signal α would be outputted over the appropriate one of the transmission clock signal line and the print clock signal line.

Further, a signal line can be provided exclusively for the distinction signal α. This configuration would allow other signals, such as for driving the print head 2 to be outputted over the print data signal line 59 during operations to distinguish the rank characteristic of a mounting print head 2.

What is claimed is:

1. A printer having a device for automatically adjusting the drive voltage of a print head according to a predetermined rank characteristic of the head, the adjusting device comprising:

a signal input line over which signals are inputted to the print head;

a delay time detection line connected to the signal input line and including a delay circuit having at least one capacitor and at least one resistor passing the signals therethrough, resulting in a delay signal corresponding to the rank characteristic of the print head;

a control unit, responsive to the delay signal furnished to the control unit from the delay time detection line, that distinguishes the corresponding rank characteristic of the print head, the control unit includes a) an output unit that outputs a distinction signal over the signal input line;

b) a detection unit that receives the delay signal and compares the delay signal to the distinction signal to detect the delay time associated with the delay signal; and c) a distinguishing unit that distinguishes the rank characteristic of the print head based on the delay time detected by the detection unit.

2. A printing device as claimed in claim 1, further comprising a driver circuit for driving the print head, the signal input line being connected to the driver circuit, the output unit outputting the distinction signal over the signal input line to the driver circuit.

3. A printing device as claimed in claim 1, wherein the delay circuit is mounted to a substrate on which the driver circuit is mounted, and wherein the delay circuit has a resistance value settable according to rank characteristic of the print head.

4. A printing device as claimed in claim 3, wherein the delay circuit has at least two resistors, at least one of the two resistors being selectively brought into parallel connection with another resistor to set resistance value according to rank characteristic of the print head.

5. A printing device as claimed in claim 2, wherein the at least one resistor of the delay circuit is a variable resistor.

6. A printing device as claimed in claim 3, wherein the print head is an ink jet type print head.

7. A printing device as claimed in claim 1, wherein the delay circuit is mounted to a substrate on which the driver circuit is mounted wherein the delay circuit has a capacitance settable in accordance with rank characteristic of the print head.

8. A printing device as claimed in claim 7, wherein the delay circuit includes at least two capacitors selectively connected with ground to set capacitance according to rank characteristic of the print head.

9. A printing device as claimed in claim 5, wherein the at least one capacitor of the delay circuit is a variable capacitor.

10. A printing device as set forth in claim 1 wherein the delay time detection line further includes a single line that connects the delay circuit to the detection unit.

11. A method for automatically adjusting the drive voltage of a print head according to a predetermined rank characteristic of the head, the method comprising the steps:

connecting a delay time detection line to a signal input line, the delay time detection line including a delay circuit having at least one capacitor and at least one resistor for passing signals from the signal input line therethrough, resulting in a delay signal;

generating a distinction signal;

applying the distinction signal over the signal input line;

comparing the delay signal with the distinction signal;

generating a signal delay time associated with the delay signal; and automatically distinguishing the rank characteristic of the print head based on the signal delay time.

12. A method as claimed in claim 12, wherein the rank characteristic distinguishes an ink jet print head.

13. A device for automatically adjusting the drive voltage of a print head according to a predetermined rank characteristic of the head, the adjusting device comprising:

an output unit that outputs a distinction signal;

a delay time detection line that receives the distinction signal as an input, the delay time detection line including a delay circuit that delays the distinction signal by an amount corresponding to the rank characteristic of the print head;

the delay time detection line outputting the delayed distinction signal;

a detection unit connected to the delay time detection line for detecting the delay of the distinction signal; and a distinguishing unit that distinguishes the rank characteristic of the print head based on the delay detection by the detection unit.

14. A printing device as claimed in claim 13, wherein the delay circuit of the delay time detection line has at least one capacitor aind at least one resistor for delaying the distinction signal inputted over the delay time detection line.

15. A printing device as set forth in claim 14 wherein the delay time detection line further includes a single line that connects the delay circuit to the detection unit.

16. A device for automatically adjusting the drive voltage of a print head according to a predetermined rank characteristic of the head, the adjusting device comprising:

a signal line carrying a reference signal during a first time interval;

a delay unit connected at an input thereof to the signal line that delays the reference signal by an amount corresponding to the rank characteristic of the print head;

a detection unit that compares the delayed reference signal to the reference signal thereby detecting the delay time therebetween;

a generating unit responsive to the delay time that generates a control signal corresponding to the delay time; and a print head driving unit connected to the signal line and responsive to the control signal, the print head driving unit generating a print head drive voltage corresponding to the rank characteristic during a subsequent time interval.

17. A printing device as set forth in claim 14 wherein the delay time detection line further includes a single line that connects the delay circuit to the detection unit.

18. A method for automatically adjusting the drive voltage of a print head according to a predetermined rank characteristic of the head, the method comprising the steps:

producing a reference signal along a signal line during a first time interval;

delaying the reference signal by an amount corresponding to the rank characteristic of the print head;

comparing the delayed reference signal to the reference signal thereby detecting the delay time therebetween;

generating a control signal corresponding to the delay time; and generating a drive voltage at a head driver output corresponding to the rank characteristic of the head, during a second subsequent time interval.

* * * * *